US010641481B2

(12) United States Patent
Donaldson et al.

(10) Patent No.: US 10,641,481 B2
(45) Date of Patent: May 5, 2020

(54) SYSTEMS AND METHODS FOR GENERATING SUPERHEATED STEAM WITH VARIABLE FLUE GAS FOR ENHANCED OIL RECOVERY

(71) Applicant: Energy Analyst LLC., Albuquerque, NM (US)

(72) Inventors: A. Burl Donaldson, Albuquerque, NM (US); Brian Hughes, Cross Plains, TX (US)

(73) Assignee: Energy Analyst LLC, Albuquerque, NM (US)

( * ) Notice: Subject to any disclaimer, the term of this patent is extended or adjusted under 35 U.S.C. 154(b) by 170 days.

(21) Appl. No.: 15/586,125

(22) Filed: May 3, 2017

(65) Prior Publication Data

US 2017/0321883 A1 Nov. 9, 2017

Related U.S. Application Data

(60) Provisional application No. 62/331,222, filed on May 3, 2016.

(51) Int. Cl.

| | |
|---|---|
| ***F22G 1/12*** | (2006.01) |
| ***E21B 43/24*** | (2006.01) |
| ***F22D 11/00*** | (2006.01) |
| ***F22G 5/20*** | (2006.01) |

(52) U.S. Cl.

CPC ..... *F22G 1/12* (2013.01); *E21B 43/24* (2013.01); *F22D 11/00* (2013.01); *F22G 5/20* (2013.01)

(58) Field of Classification Search

CPC ..... E21B 43/24; E21B 36/008; E21B 36/04; F22G 5/16; F22G 5/20; F22G 3/005; F22G 1/22; F22D 11/00; F22D 1/08; F22D 1/28

See application file for complete search history.

(56) References Cited

U.S. PATENT DOCUMENTS

| | | | | | |
|---|---|---|---|---|---|
| 132,274 | A * | 10/1872 | Fuller | ..... | F22D 11/00 122/451 R |
| 853,665 | A * | 5/1907 | Wieland | ..... | F22D 11/00 122/451 R |
| 1,960,770 | A * | 5/1934 | Brown | ..... | F22D 1/28 165/114 |

(Continued)

FOREIGN PATENT DOCUMENTS

| | | | | |
|---|---|---|---|---|
| CA | 2621991 | | 11/2008 | |
| CA | 2676717 | A1 * | 2/2010 | ..... F22B 1/1853 |

(Continued)

OTHER PUBLICATIONS

"Technology of oil and bitumen output stimulation by heat from reactions of downhole Binary Chemical Mixtures (BM)", www.viscos-energy.com, 2013.

(Continued)

*Primary Examiner* — Jennifer H Gay

(74) *Attorney, Agent, or Firm* — Peacock Law P.C.; Justin R. Jackson

(57) ABSTRACT

Systems and methods are disclosed for producing a superheated steam having a specified ratio of water vapor to combustion gases for injection into a well to enhance heavy oil production. Embodiments comprise indirect-contact steam generators and direct-contact steam generators.

19 Claims, 6 Drawing Sheets

(56) References Cited

U.S. PATENT DOCUMENTS 2,076,669 A * 4/1937 Redfield ..... E21B 36/04 392/303
2,420,624 A * 5/1947 Schaub ..... F22D 11/00 122/412
2,515,648 A * 7/1950 Hunt ..... F22D 1/28 122/442
2,969,226 A * 1/1961 Huntington ..... E21B 43/2405 166/261
3,221,714 A * 12/1965 Dickey ..... F22G 5/12 122/479.1
3,360,044 A * 12/1967 Lange ..... E21B 43/24 166/260
3,420,301 A 1/1969 Riley et al.
3,456,721 A * 7/1969 Smith ..... E21B 36/02 166/59
3,946,809 A 3/1976 Hagedorn
4,092,128 A * 5/1978 Harris ..... C10B 53/06 201/28
4,199,025 A 4/1980 Carpenter
4,228,853 A 10/1980 Harvey et al.
4,366,860 A 1/1983 Donaldson et al.
4,378,846 A 4/1983 Brock
4,398,603 A * 8/1983 Rodwell ..... E21B 36/00 122/1 R
4,398,604 A 8/1983 Krajicek et al.
4,411,618 A 10/1983 Donaldson et al.
4,412,124 A 10/1983 Kobayashi
4,463,805 A 8/1984 Bingham
4,498,542 A * 2/1985 Eisenhawer ..... E21B 36/025 166/303
4,546,829 A * 10/1985 Martin ..... B01J 19/14 166/267
4,648,835 A 3/1987 Eisenhawer et al.
4,662,439 A * 5/1987 Puri ..... E21B 43/30 166/245
4,682,471 A * 7/1987 Wagner ..... F01K 21/047 166/303
4,703,800 A 11/1987 Hanna
4,783,585 A 11/1988 Meshekow
5,142,608 A * 8/1992 Meshekow ..... E21B 36/006 166/50
5,623,576 A 4/1997 Deans
7,121,342 B2 * 10/2006 Vinegar ..... E21B 36/02 166/302
7,591,309 B2 9/2009 Minnich et al.
7,694,736 B2 * 4/2010 Betzer Tsilevich ..... E21B 43/24 166/267
7,770,646 B2 * 8/2010 Klassen ..... E21B 43/164 166/303
8,235,118 B2 8/2012 Schultz et al.
8,371,371 B2 2/2013 Diehl et al.
8,387,692 B2 * 3/2013 Tilmont ..... E21B 36/02 166/272.3
8,522,871 B2 * 9/2013 Anderson ..... E21B 43/2406 166/272.1
8,573,292 B2 11/2013 Ware et al.
8,789,608 B2 * 7/2014 Betzer-Zilevitch ..... B03D 1/02 122/6 R
9,114,406 B2 * 8/2015 Betzer Tsilevich ..... B03D 1/02
9,140,445 B2 * 9/2015 Tomita ..... F22B 1/284
9,249,972 B2 * 2/2016 Mays ..... E21B 43/24
9,383,093 B2 * 7/2016 Tilmont ..... E21B 36/02
9,909,401 B2 * 3/2018 Patterson ..... C02F 1/06
10,087,730 B2 * 10/2018 Latimer ..... B01D 5/0069
2005/0051327 A1 * 3/2005 Vinegar ..... E21B 36/02 166/256
2007/0102152 A1 5/2007 Forgeron
2007/0234702 A1 * 10/2007 Hagen ..... B60H 1/032 60/39.01
2008/0017381 A1 1/2008 Baiton
2008/0083537 A1 * 4/2008 Klassen ..... E21B 43/164 166/302
2008/0190607 A1 * 8/2008 Minnich ..... E21B 43/2406 166/267
2008/0289821 A1 * 11/2008 Betzer Tsilevich ..... E21B 43/2406 166/272.3
2008/0289822 A1 * 11/2008 Betzer Tsilevich ..... E21B 43/24 166/272.3
2010/0037835 A1 * 2/2010 Betzer Tsilevich ... F22B 1/1853 122/11
2010/0050517 A1 * 3/2010 Tsilevich ..... F22B 1/1853 48/127.1
2010/0170453 A1 * 7/2010 Betzer-Zilevitch ..... B03D 1/02 122/6 R
2010/0224363 A1 * 9/2010 Anderson ..... E21B 43/2406 166/266
2011/0036095 A1 * 2/2011 Krajicek ..... E21B 43/24 60/775
2011/0036308 A1 * 2/2011 Betzer-Zilevitch ..... F22B 1/1853 122/5.52
2011/0056442 A1 * 3/2011 Betzer Tsilevich ... F22B 1/1853 122/11
2011/0127036 A1 * 6/2011 Tilmont ..... E21B 36/02 166/303
2011/0214858 A1 * 9/2011 Castrogiovanni ..... E21B 36/02 166/272.1
2011/0232545 A1 * 9/2011 Clements ..... F22B 1/1853 110/234
2012/0000642 A1 * 1/2012 Betzer Tsilevich ..... B03D 1/02 166/57
2012/0152546 A1 6/2012 Polizzotti et al.
2013/0168093 A1 7/2013 Qu et al.
2013/0340691 A1 * 12/2013 Tilmont ..... E21B 36/02 122/31.1
2014/0110109 A1 * 4/2014 Latimer ..... F22B 1/18 166/267
2014/0166301 A1 6/2014 Corre
2014/0190698 A1 * 7/2014 Mays ..... E21B 43/24 166/303
2015/0122497 A1 5/2015 Donaldson
2015/0295158 A1 * 10/2015 O'Donnell ..... E21B 43/24 136/206
2015/0329785 A1 * 11/2015 Vinegar ..... C10L 1/04 507/242
2015/0369025 A1 * 12/2015 Latimer ..... B01D 5/0069 166/303
2016/0047218 A1 * 2/2016 Patterson ..... C02F 1/06 166/266
2017/0247994 A1 * 8/2017 Parrella ..... E21B 36/003
2017/0321883 A1 * 11/2017 Donaldson ..... E21B 43/24
2018/0010434 A1 * 1/2018 Kuhlman ..... E21B 43/2405

FOREIGN PATENT DOCUMENTS

CA 2715619 A1 * 5/2011 ..... E21B 43/24
CA 2752558 A1 * 3/2012 ..... E21B 43/24
CA 2747766 1/2013

OTHER PUBLICATIONS

Donaldson, "Reflections on a Downhole Steam Generator Program", Society of Petroleum Engineers, Inc., 1997.
Doscher, et al., "Steam Drive Definition and Enhancement", J. Pet. Tech. Forum, Jul. 1982, 1543-1545.
Herron, "In Situ Hydrovisbreaking", Sep. 2003.
Kanaan, "Direct Electric Heating of Electrolyte Solutions", May 2010.
Pang, et al., "The Role Analysis of Superheated Steam Injection to Improve Performance in Thin Heavy Oil Reservoir", Journal of Industrial and Intelligent Information, vol. 2, No. 3, Engineering and Technology Publishing, Sep. 2014, 189-193.
Proctor, et al., "Steam Injection Strategies for Thin, Bottomwater Reservoirs", Society of Petroleum Engineers, Paper SPE 16338, 1987, 141-149.

(56) References Cited

OTHER PUBLICATIONS

Shipley, "The Alternating Current Electrolysis of Water", Canadian Journal of Research, 1929, 305-358.
Stapp, "In Situ Hydrogenation", Fossil Energy, Dec. 1989.
Western Research Institute, "Development and Demonstration of a Practical Electric Downhole Steam Generator for Thermal Recovery of Heavy Oil and Tar", http://uwdigital.uwyo.edu/islandora/object/wyu%3A11367, Mar. 1993.
Zhang, "Experimental Study of In-Situ Upgrading for Heavy Oil Using Hydrogen Donors and Catalyst Under Steam Injection Condition", Office of Graduate Studies of Texas A&M University, May 2011.
Zhou, "Improvement of porous medium permeability by injecting overheated steam", Advanced Materials Research, vol. 668, Trans Tech Publications, Switzerland, Mar. 11, 2013, 279-282.

* cited by examiner

SYSTEMS AND METHODS FOR GENERATING SUPERHEATED STEAM WITH VARIABLE FLUE GAS FOR ENHANCED OIL RECOVERY

CROSS-REFERENCE TO RELATED APPLICATIONS

This application claims priority to U.S. Provisional Patent Application Ser. No. 62/331,222, entitled "A Method for Generating Superheated Steam with Variable Flue Gas for Enhanced Oil Recovery", filed on May 3, 2016, and the specification and claims thereof are incorporated herein by reference.

BACKGROUND OF THE INVENTION

Field of the Invention (Technical Field)

Embodiments of the present invention relate to generation of superheated steam with variable flue gas for enhanced oil recovery.

Description of Related Art

Heavy oil formations can be stimulated to production by steam delivered downhole via injection tubing, for example as described in U.S. Pat. Pub. No. 2015/0122497 entitled "Direct Electrical Steam Generation for Downhole Heavy Oil Stimulation." Because of the known reduction in viscosity of oil at elevated temperature, a commonly practiced technology is to inject steam from a once-through surface located steam generator into the oil bearing formation via tubing installed in the well casing. The typical steam generator is an indirect contact design which separates the flue gases from the pressurized water to be partially vaporized. Hence, combustion can be carried out at low pressure and the flue gases are vented to the atmosphere. Because the steam is generated in a once-through boiler, the quality of steam is generally no higher than 80% so that dissolved solids associated with the feedwater will concentrate in the liquid phase but remain in solution and be conducted into the reservoir.

In many cases, some variable level of flue gas injection with the steam is desirable or necessary. Heavy oil formations are frequently under-pressurized, so the non-condensable gases, such as carbon dioxide and nitrogen, can provide a drive mechanism to move mobilized oil to the production well. Such advice is provided by Todd M. Doscher, Osazuwa S. Omoregie, and Farhad Ghassemi, "Steam Drive Definition and Enhancement", J, Pet, Tech. Forum (July 1982), and M. L. Proctor, A. E. George and S. M. Farouq Ali, "Steam Injection Strategies for Thin, Bottomwater Reservoirs", Society of Petroleum Engineers, Paper SPE 16338 (1987). A practice that provides for the injection of flue gases with steam is the direct contact steam generator. In a direct contact steam generator, pressurized water is injected into the pressurized hot combustion flue gases directly. This results in vaporization of some fraction of the water, depending on relative flow rates. In deep reservoirs with thick oil bearing formations and high permeability, the injection of large quantities of non-condensable gases can be achieved. This is because these gases do not occupy a high volume at high pressure as they would at lower pressure. In fact, direct contact steam generators can be found referenced in the open literature and the patent data base, for example, U.S. Pat. No. 4,366,860.

Recent studies and practices have shown that superheated steam can have beneficial effects with regard to the recovery of heavy oil, for example, Zhanzi Pang and Chengxiang Qi, "The Role Analysis of Superheated Steam Injection to Improve Performance in Thin Heavy Oil Reservoir", 2 Journal of Industrial and Intelligent Information 3 (September 2014), and Ti-Yao Zhou, "Improvement of Porous Medium Permeability by Injecting Overheated Steam", 668 Advanced Materials Research 279 (2013). Superheated steam is known in the industry to be water vapor with at least 100% saturation that increases in temperature as energy is added. By injecting superheated steam (and flue gases) that for a given pressure provides high temperature injection fluids, as compared to less-saturated steam at a lower temperature from a surface boiler, a number of benefits are observed: superheat can further reduce viscosity of the heavy oil, which is a recognized impediment to flow in production well(s); improvement in permeability of the formation has been demonstrated in laboratory scale studies, presumably owing to the decomposition of carbonates or matrices which consolidate the formation sands; with superheat, boiling of formation interstitial water at local pressure will occur which is anticipated to eject oil trapped in pore spaces; superheat is expected to pyrolyze heavy oil into lighter fractions, including methane, and such lighter fractions will move more readily into virgin oil ahead of heated zone and due to solubility, will dissolve in the oil and cause a reduction in viscosity; produced methane will come out of solution as formation pressure is reduced in the vicinity of the production well and can be a viable boiler fuel for the indirect contact boiler.

In addition to further reduction in viscosity, a permanent improvement in formation permeability and ultimate recovery have been experienced when the superheated condition is employed. Hence, it can be desirable to inject both superheated steam and flue gases simultaneously—for example as described in U.S. Pat. Nos. 4,398,604 and 7,694,736. This is because the flue gases do not condense and remain in the gaseous state to augment or provide a drive mechanism. However, the hardware of known systems is complicated, expensive and cumbersome for practices requiring portability, such as huff-and-puff stimulation. And in both U.S. Pat. Nos. 4,398,604 and 7,694,736, water dissolved solids are concentrated in a liquid phase for disposal so that untreated water can be supplied to the system. Any elevated temperature of the disposed concentrate represents an energy loss and this concentrate will typically be corrosive to carbon steel. What is needed is a hardware design which will provide for a wide range of combinations of single or two-phase steam with or without flue gases, or superheated steam with a controllable quantity of flue gases.

In addition to improvement in reservoir permeability, high temperature pyrolysis of oil (heating without oxidizer) has been observed when the superheated condition is employed. Such high temperatures can be achieved with a superheater, where water saturation temperature is not a limitation. Thermal equilibrium calculations and literature reports have indicated that heavy oil will readily decompose, at high temperature and inert environment, into lighter hydrocarbon fractions, including methane and other light hydrocarbons. These hydrocarbons can be either gaseous or liquid depending on local pressure, temperature, and solubility in heavier hydrocarbon fractions. Hence, as these light fractions propagate ahead of the high temperature regions in the formation, there should be solubility of these lighter fractions in the virgin crude oil, which will reduce its viscosity and augment flow of the production well(s). As these gases migrate even farther into the virgin oil, the pressure will drop towards the production well, and particularly methane will come out of solution and be produced as a gas at the production well. Because methane cannot be vented into the atmosphere, it can be either compressed for pipeline addition, or can be burned on-site as the fuel for the indirect contact boiler. Although the methane will be diluted with nitrogen and carbon dioxide from the superheater, burners for low Btu gas are readily available. Hence, methane will be consumed, and only water vapor, carbon dioxide and nitrogen will be vented from the indirect contact boiler. It is recognized that production of methane will be delayed following start-up of thermal stimulation so that a market available fuel or heating source will be needed initially.

To support the contention that heavy oil is converted to gas in an inert environment, Los Alamos National Laboratories performed TGA (Thermo-Gravimetric Analysis) measurements on a Missouri heavy oil sample and found that at 500 C, almost 90% of the sample was converted to gas with more than 10% remaining as a carbon rich residue which may ultimately be suitable to support a subsequent fireflood. Another laboratory investigation studied in-situ pyrolysis of heavy oil with and without injection of a catalysis whose function was provision of a hydrogen donor. See Zhiyong Zhang, "Experimental Study Of In-Situ Upgrading For Heavy Oil Using Hydrogen Donors And Catalyst Under Steam Injection Condition", Office of Graduate Studies of Texas A&M University (May 2011). Both studies showed positive upgrading of the heavy oil with the catalyst case showing additional benefit. Further chemical equilibrium calculations show that higher hydrocarbons, in the presence of nitrogen, water vapor, and carbon dioxide (constituents from a direct contact superheater) will undergo pyrolysis to produce, in addition to methane and lighter hydrocarbons, free hydrogen; a constituent found to supplement heat alone for heavy oil upgrading.

Because oil formations and oils occur in a very wide range of compositions and formation types, it is desirable to have a stimulation technique which is highly adaptable to the need. Once-through boilers do not inject flue gases and do not inject superheated steam. Rather, once-through boilers discharge flue gases to the environment. The amount of discharge can be a consideration for air quality permitting in sensitive areas. On the other hand, direct contact steam generators, where all of the flue gases are injected with steam, can encounter another set of difficulties. In shallow, thin formations with low permeability, the flue gases occupy significant volume in the formation and inhibit continued injection of fluids. In environmentally sensitive areas, flue gases injected into the formation may need to be captured if they return to the surface, and disposed of in an appropriate manner. Hence, it may be desirable to keep the flue gas/steam ratio within some constraints which match the need.

From a formation engineer's perspective, it may be advisable to initially stimulate the formation with hot water or steam containing some fraction of liquid water, with or without flue gases. Although conventional boilers, designed for a specified throughput, are available to provide input to a direct contact steam generator, it would be cumbersome to use multiple thermal tools to provide this variability. Matching the two systems presents design problems unaddressed by known systems.

In the traditional direct contact steam generator, the combustor chamber ("can") was cooled by feedwater that was still in the liquid state, so that high heat transfer coefficients would be experienced. If saturated steam vapor is entering the direct contact steam generator or superheater, then vapor heat transfer coefficients will be considerably lower and overheating of the combustor is possible. What is needed is a design for a direct contact steam generator or superheater, the combustor of which is protected from adiabatic flame temperatures at the stoichiometric condition (exactly the correct ratio of fuel to oxidizer, i.e., equivalence of unity) where temperatures are expected to be around 2200 K.

In order to deliver superheated steam to deep heavy oil formations, it is important to keep heat losses in the steam injection tubing to an absolute minimum, and even then, casing stresses and failure and leaking of high temperature thermal packers (which have temperature ratings consistent with saturated steam at much lower temperature) can be anticipated. As described in U.S. Pat. No. 4,366,860, a high energy output direct contact steam generator, operating at high pressure, can be sufficiently compact to be installed in conventional casing dimensions. What is needed is a downhole superheater, where deep formations are to be treated.

BRIEF SUMMARY OF THE INVENTION

One object of the present invention is to provide systems and methods that can produce a desired combination of single or two-phase steam with or without combustion gases, or superheated steam with a controllable quantity of combustion gases, to enhance oil recovery from a given well. The systems and methods comprise a direct-contact steam generator or superheater ("superheater") capable of performing combustion and operating on feedwater in either a liquid state or a gas state or some combination of both states and generating a superheated steam having a specified ratio of non-condensable combustion gases to feedwater vapor for injection into the well. The systems and methods of the present invention comprise an indirect-contact steam generator for generating a specified quantity and/or quality of feedwater vapor for delivery to the superheater.

Another object of the present invention is to provide systems and methods of cooling the superheater in systems generating superheated steam. The systems and methods include lining the combustion chamber of the superheater with a refractory material, extending the surface of the combustion chamber of the superheater to expose it to water and/or water vapor, diverting water vapor from the indirect-contact steam generator directly into the combustion chamber of the superheater, and using feedwater to cool the superheater before that feedwater is used in the indirect-contact steam generator.

Yet another object of the present invention is to provide systems and methods of generating superheated steam that are adaptable to operate at any of the anticipated field conditions. The systems of the present invention comprise programmable logic control systems, computers, or software that govern the fuel and oxidizer inputs on the superheater and indirect-contact steam generator and meters for controlling the quantity of feedwater and water vapor passing through various sections of the system or into various parts of the system. The systems of the present invention can be compact and portable for transportation and relocation to other wells or other fields. The superheater of some systems can be placed downhole within the well to locate the superheating at a location within the well to prevent certain problems within the well caused by superheating.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DETAILED DESCRIPTION OF THE INVENTION

Figure 1:
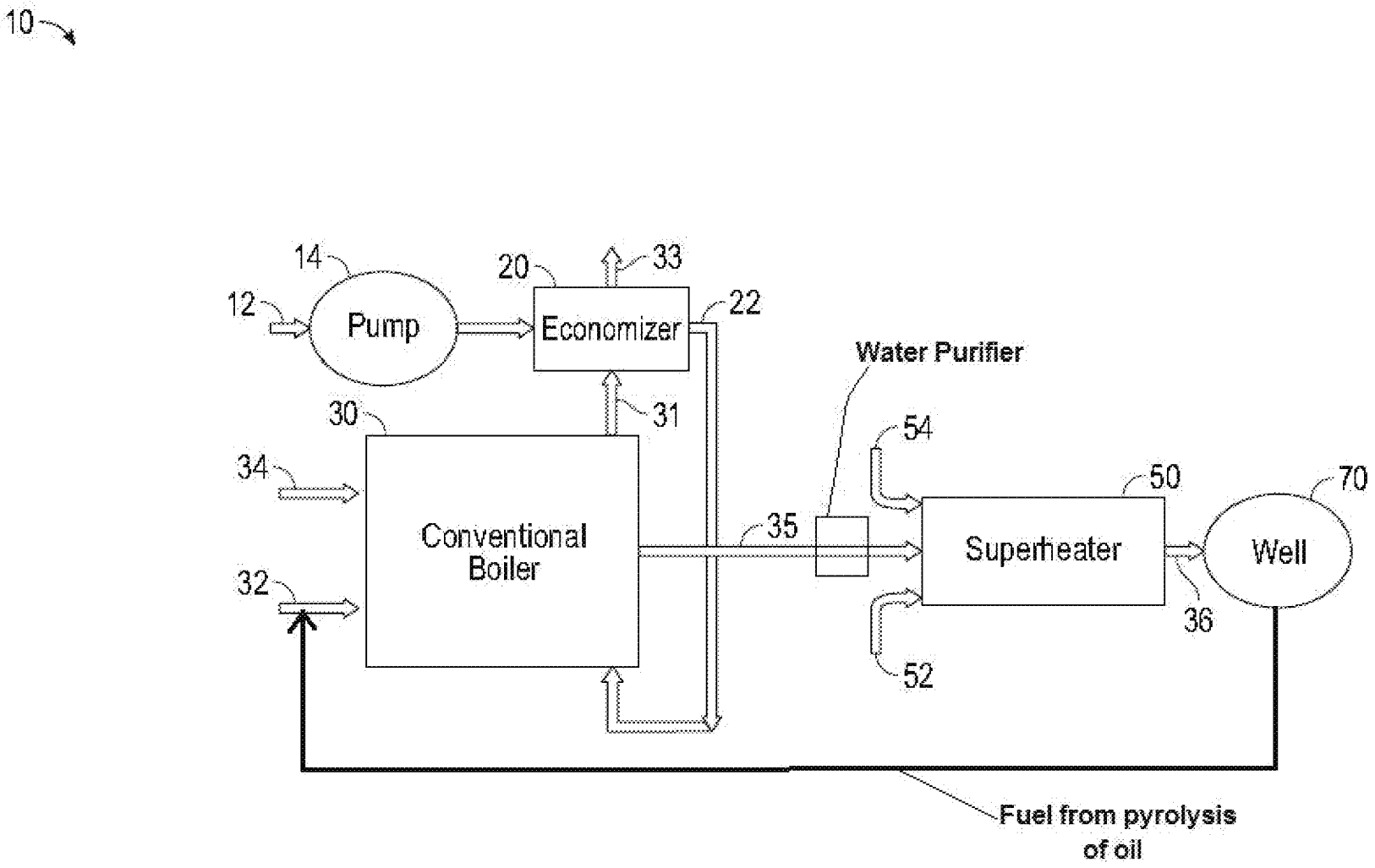
FIG. 1 is a schematic illustration of a "hybrid" embodiment of the present invention.

Referring to the figures, embodiments of the present invention comprise indirect contact boiler 30 to impart the desired amount of energy into water vapor/steam 35 and direct-contact steam generator or superheater ("superheater") 50 where a controlled amount of fuel 52 and oxidizer 54 burning at high pressure will then co-mingle with water vapor 35 from indirect contact boiler 30 to result in either two phase steam or superheated steam with a specified quantity of combustion gases ("flue gases") to be injected into well 70. By controlling the firing rate (the amount of fuel and air) in boiler 30 relative to the firing rate in superheater 50, the quantity of flue gas relative to water vapor ("steam") may be varied as specified to the need.

Referring to FIG. 1 illustrating a preferred layout of system 10, cold feedwater 12 enters system 10 by pump 14. Preferably, feedwater 12 is softened and filtered before it enters system 10 by, for example, ion exchange softener to remove hardness minerals and then single or multiple pass reverse osmosis to remove most or all of the dissolved solids, and reject brine is preferably discharged from system 10 at room temperature. Preferably, the feedwater is purified to remove most if not all of the solids such that its purity does not exceed a nominal amount of about 25 parts per million of solids. By removing most or all of the dissolved solids from the feedwater before it enters the system 10, system 10 can produce the superheat steam condition without separating a hot liquid component for disposal. Preferably, feedwater 12 is then passed through economizer 20 in the stack from the indirect contact boiler 30. Hot flue gases 31 emitted by boiler 30 are used by economizer 20 to heat cold feedwater 12 to create hot water 22 for boiler 30. Cooled flue gases 33 are vented/discharged out of economizer 20. Preferably, boiler 30 comprises high pressure water tubes and a controlled, low-pressure burner comprising a volume control on its fuel supply 32 and combustion air supply 34 to impart the desired amount of energy into exiting water 35. The quality of the steam/water vapor 35 exiting boiler 30 is preferably controlled by a programmable logic controller (PLC), which may direct the exiting water vapor 35 to be up to 100% saturation. The saturated vapor state (up to 100% saturation) is possible because there will be no solids to deposit boiler 30, once vaporization is complete.

Referring to FIG. 1 illustrating a preferred layout of system 10, cold feedwater 12 enters system 10 by pump 14. Preferably, feedwater 12 is softened and filtered before it enters system 10 by, for example, ion exchange softener to remove hardness minerals and then single or multiple pass reverse osmosis to remove all of the dissolved solids, and reject brine is preferably discharged from system 10 at room temperature. By removing all of the dissolved solids from the feedwater before it enters the system 10, system 10 can produce the superheat steam condition without separating a hot liquid component for disposal. Preferably, feedwater 12 is then passed through economizer 20 in the stack from the indirect contact boiler 30. Hot flue gases 31 emitted by boiler 30 are used by economizer 20 to heat cold feedwater 12 to create hot water 22 for boiler 30. Cooled flue gases 33 are vented/discharged out of economizer 20. Preferably, boiler 30 comprises high pressure water tubes and a controlled, low-pressure burner comprising a volume control on its fuel supply 32 and combustion air supply 34 to impart the desired amount of energy into exiting water 35. The quality of the steam/water vapor 35 exiting boiler 30 is preferably controlled by a programmable logic controller (PLC), which may direct the exiting water vapor 35 to be up to 100% saturation. The saturated vapor state (up to 100% saturation) is possible because there will be no solids to deposit boiler 30, once vaporization is complete.

Figure 5:
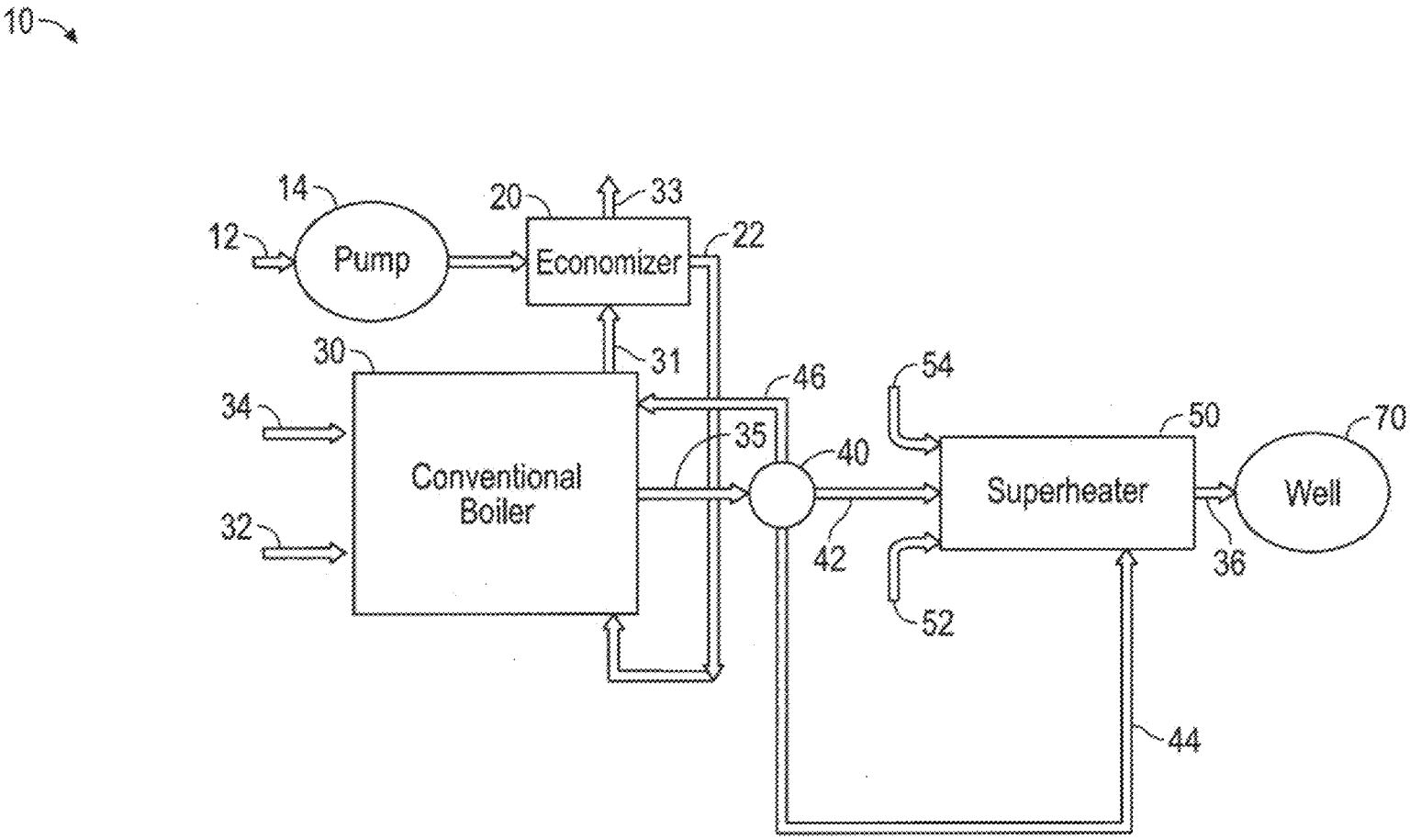
FIG. 5 is a schematic illustration of an embodiment of the present invention comprising a partial vapor injector cooling system for the superheater.
Figure 6:
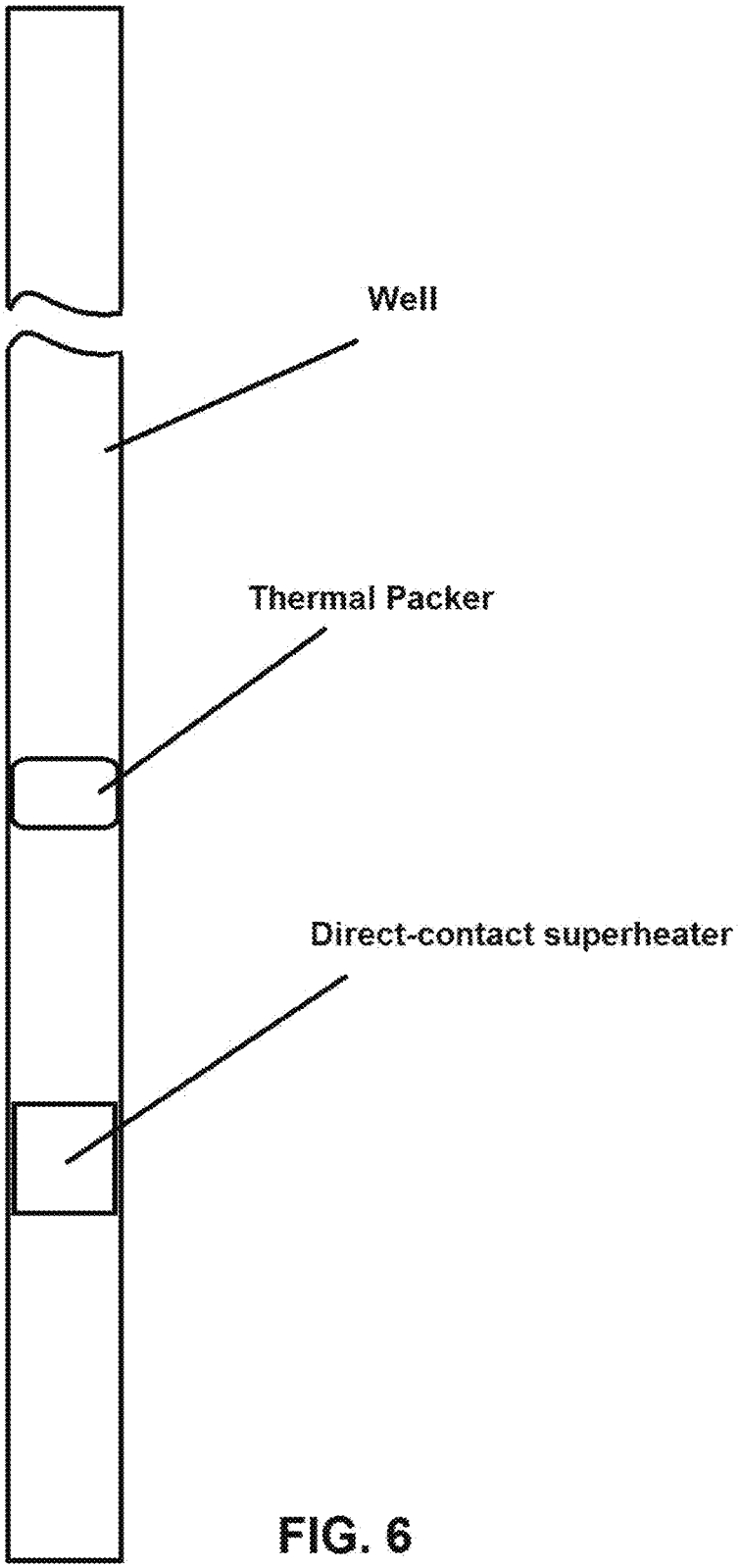
FIG. 6 is a drawing which illustrates a direct-contact superheater located within a well and below a thermal packer.
Figure 7:
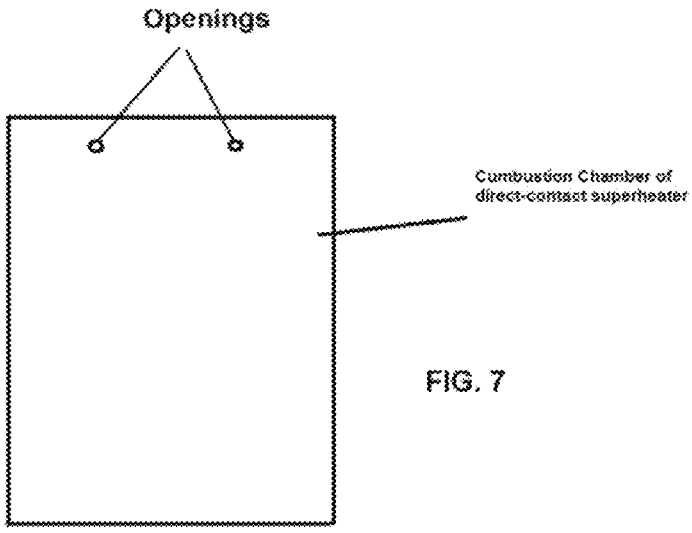
FIG. 7 is a drawing which illustrates the openings in the combustion chamber of a direct-contact superheater located within a well and below a thermal packer.

Referring to an alternate configuration of system 10 illustrated in FIG. 5, water vapor 35 exiting boiler 30 may pass through separator 40 where at least a fraction of the vapor phase 42 of water vapor 35 passes to superheater 50 and the liquid phase 46 of water vapor 36 is returned to the boiler feed. A fraction 44 of the vapor phase 42 of water vapor 36 may be passed to a cooling jacket on superheater 50. Occasional blow-down to rid the water supply of dissolved minerals can dispose of concentrated dissolved solids. An electrical conductivity meter can be used to determine frequency of blow-down. While there is no precise level of conductivity for which blow down must occur, preferably a blow-down is initiated when the conductivity is about 4 to 10 times the electrical conductivity of the feedwater 12, or if there is an apparent build-up of minerals in the system. Flue gases from indirect contact unit 30 will then be discharged at atmospheric pressure.

Vapor 35 exiting boiler 30 or vapor 42 exiting separator 40 will enter the superheater 50. Superheater 50 will burn a specified quantity of fuel 52 and oxidizer 54 at sufficient pressure for reservoir injection, and the combustion products will then co-mingle with the entering steam vapor 35 or 42 to produce an effluent 36 which will contain a desired ratio of flue gases to steam. By reducing the flow of vapor 35 or 42 or reducing the firing rate of boiler 30, an energy balance will determine the exiting fraction of water in the vapor phase or the degree of superheat from system 10. Because the steam, even if it is in the saturated region, will not contain solids, then no precipitation of solids will occur and fluids and gases from the hybrid system can be injected directly into a well for heavy oil stimulation. Embodiments of the present invention can be capable of operating direct contact section (superheater 50) using either compressed air or gaseous oxygen as the oxidizer to produce either saturated steam with nitrogen/carbon dioxide flue gases or superheated steam with nitrogen/carbon dioxide flue gases or saturated steam with only carbon dioxide flue gas or superheated steam with only carbon dioxide flue gas. Embodiments can be capable of operating in the output range from the condition of hot water with no co-mingled flue gases and extending to the superheated state with a specified quantity of flue gases.

Embodiments of the present invention use the superheated steam to promote pyrolysis of heavy oil. Pyrolysis occurs in formation oil at elevated superheat temperatures in the absence of free oxygen, which produces liquid and gaseous fuels, the liquid component being soluble in the virgin oil. The liquids and gaseous fuels produced by the pyrolysis include methane and/or other combustible gases. Preferably, the methane and/or other combustible gases produced by pyrolysis are used as fuel for boiler 30 or other heating purposes such as heater treaters or pipeline. Some amount or all of the fuels created by the pyrolysis can be reinjected back into the well. In some embodiments, the pyrolysis created fuels may be used as fuel for superheater 50.

Embodiments of the present invention comprise methods and apparatuses for cooling the combustion region ("can") 60 (see FIG. 2) of superheater 50, the choice of the cooling method and apparatuses depending on the expected needs of the formation stimulation. Embodiments of the present invention may employ any combination of the methods for cooling described herein or other methods.

Figure 2:
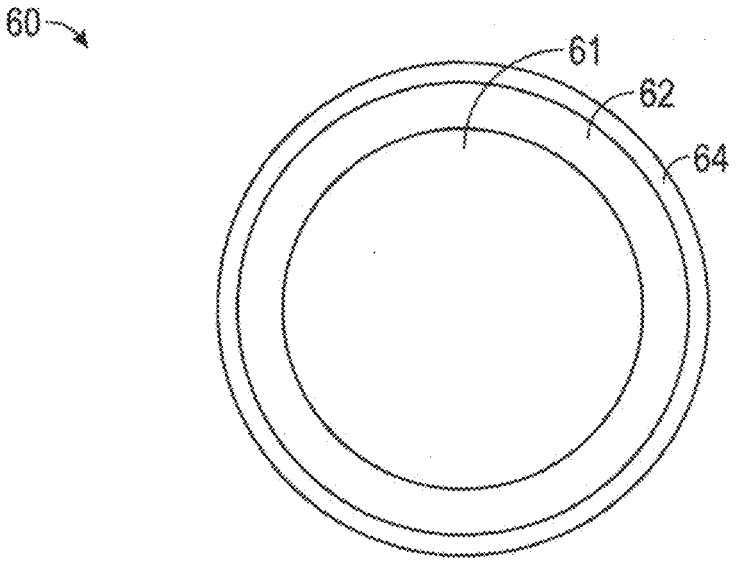
FIG. 2 is a cross-sectional view of a combustor can of an embodiment of the present invention comprising a refractory liner taken perpendicular to the longitudinal axis of the combustor can of the superheater.

Referring to FIG. 2, the first of such cooling methods is to surround combustion region 61 with refractory liner 62 formed of a material that can withstand the expected temperature ranges of the combustion (the adiabatic combustion temperatures of fuel and oxidizer metered to the stoichiometric value, i.e., equivalence of unity), such as zirconia. Preferably, refractory liner 62 is contained within shell 64, which is most preferably formed from stainless steel, so that water vapor will not penetrate refractory liner 62, but the cooling water vapor will be sufficient for survival of shell 64 given the protection provided by refractory liner 62. It may be necessary to assure that any liquid water fraction of the entering steam does not encounter a hot refractory liner 62, which could lead to thermal shock failure. As such, for particular applications, it may be desirable to provide separator 40 if two phase water is delivered from the boiler 30. The liquid component from the separator 40 can then be injected downstream of the combustor of superheater 50.

Figure 3:
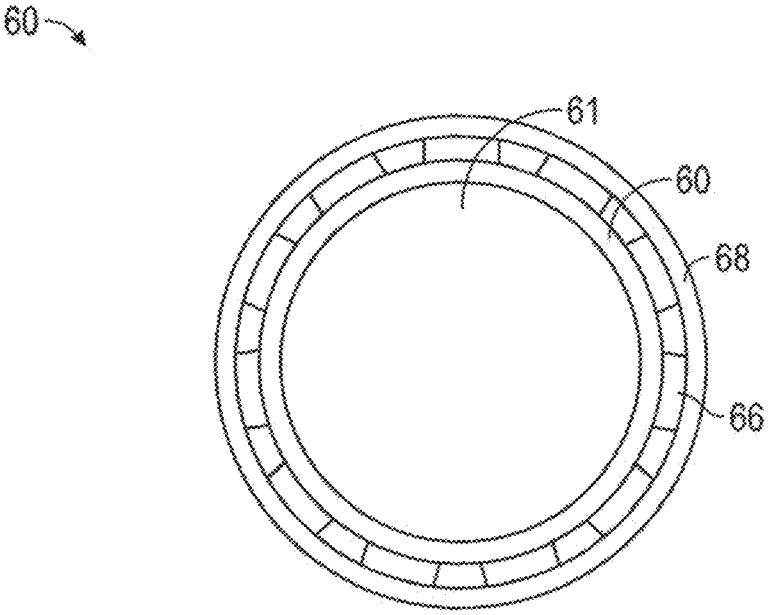
FIG. 3 is a cross-sectional view of a combustor can of the superheater an embodiment of the present invention comprising a finned external surface taken perpendicular to the longitudinal axis of the combustor can.

A second method for cooling combustor can 60 of superheater 50 is to incorporate an extended surface 66 and 68 on the outside of combustion can 60, as illustrated in FIG. 3, to provide sufficient surface area in contact with the two phase steam/water vapor so that the inner walls of the combustor remain at material survival temperatures or below. The extended surface 66 and 68 compensates for the reduction in heat transfer coefficient because the cooling fluid surrounding the combustor can 60 will now be either hot two phase steam or water vapor (~600K) and not provide for cooling levels compared to liquid water as the cooling medium. This configuration can include a series of fins 66 surrounding the combustor can 60, and the saturated water vapor preferably passes down these longitudinal fins, similar to what is used for air cooled engines or compressors. The combustor can 60 can include a liner of high alloy metal with a low thermal expansion coefficient, for example Invar, to resist thermal expansion and attendant high temperature fatigue or corrosion, and can be installed by "tight or shrink fit" into sleeve 68 through which water vapor enters superheater 50 before co-mingling with combustion gases. Finned embodiments of combustor can 60 provide good thermal contact between the combustor can 60 and intermediate shell 68.

A third method for cooling combustor can 60 of superheater 50 is to divert a metered quantity of saturated water vapor 35 from boiler 30 and pass it directly through combustor 60 of superheater 50 to moderate reaction temperatures. Preferably this stream 35 is controlled (metered) if conditions are variable such that combustion temperatures will remain above the minimum required for flame propagation and sufficiently high for good combustion. It is preferable to maintain the concentration of oxygen entering the combustor to around 13% or higher in order to remain in the flammable region, so that the water vapor dilution can be maintained below this constraint. In the case that oxygen is used as the oxidizer, then sufficient water vapor to bring oxygen concentration entering the combustor can 60 down to 13%-21% will provide for combustion conditions similar to the use of air as the oxidizer, but without nitrogen as the diluent. Preferably, a conventional high-alloy metal is used in the direct contact steam generator or superheater 50 because such metal can withstand thermal shock. Methods of diversion can include porting small openings in the top of combustor can 60, and/or keeping the length of combustor can 60 at approximately the length of flow re-attachment following the sudden expansion leading into the flame holder, thus entraining a fraction of water vapor. To accomplish partial water induction into the combustor can 60, some embodiments of the present invention use a short can of a length corresponding approximately to the recirculation region in the wake of the flame holder expansion. For example, with an inlet air and fuel port with diameter 0.5 inches, and a combustor can whose diameter is from about 2.5 to about 3 inches, the recirculation region is about 6 inches long. Hence, if combustor can 60 is more than about 6 inches, some water vapor emanating from outside combustor can 60 will be entrained up into the flame holder region and moderate combustion temperature. The length of the recirculation region is preferably characterized in terms of the expansion ratio at the step into the flame holder.

Figure 4:
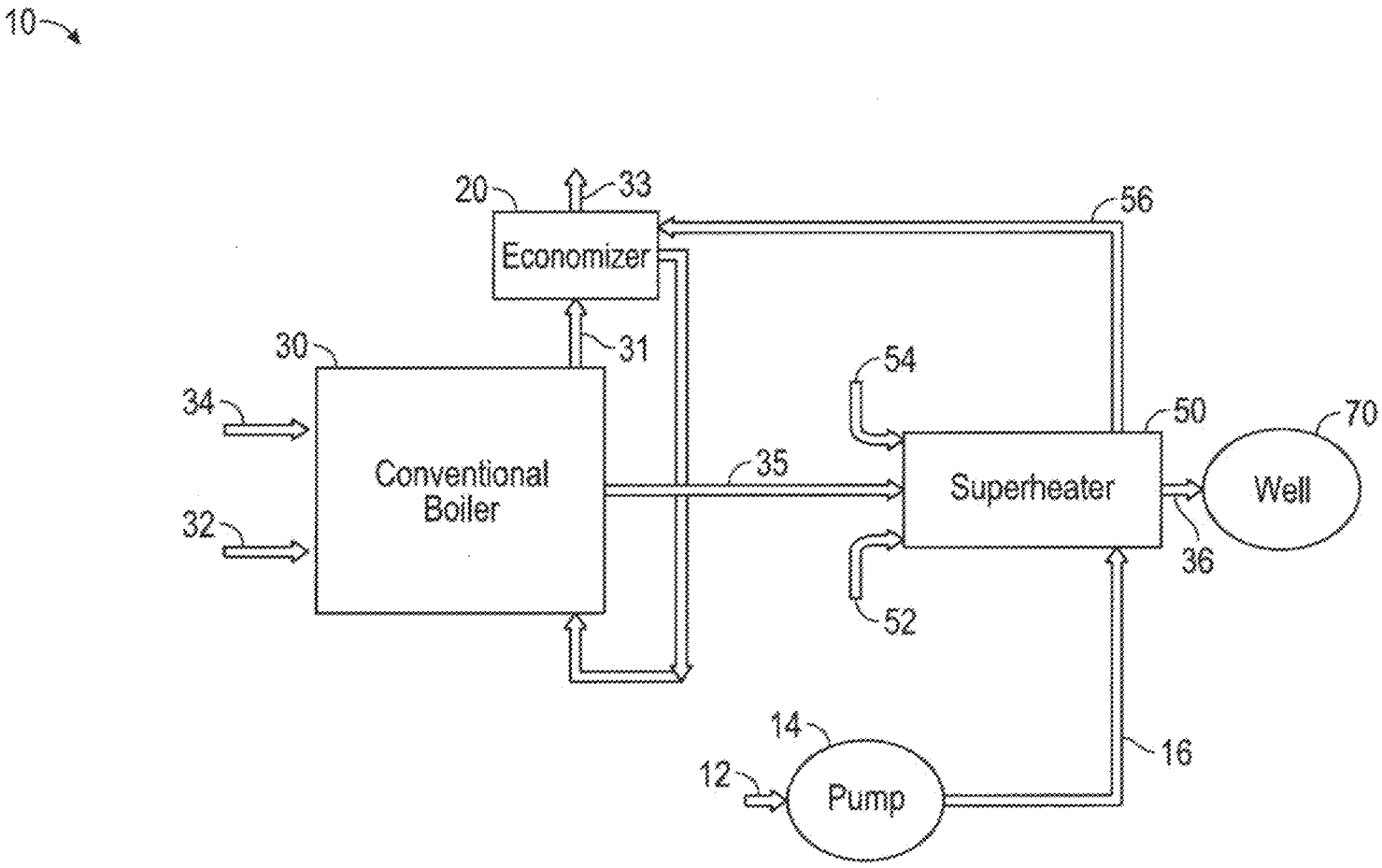
FIG. 4 is a schematic illustration of an embodiment of the present invention comprising a liquid-water cooling system for the superheater.

Referring to FIG. 4, a fourth method for cooling combustor can 60 of superheater 50 is to use feedwater 12 for cooling before feedwater 12 enters boiler 30 (or economizer 20 of boiler 30). Cold feedwater 12 is preferably pumped by pump 14 as cooling water 16 to enter superheater 50 before exiting as warm water 56 to enter economizer 20. Saturated steam 35 from boiler 30 is then preferably introduced through porting below the combustor 60 in superheater 50 at such a point that combustion is complete. Thus, the extinction of the combustion reaction can be avoided. In order to compensate for growth of combustor 60 due to high temperature, a sliding seal can optionally be disposed between the water jacket of superheater 50 and combustor can 60, in much the same way the industrial engines with liners and back side water cooling are configured. This allows for thermal expansion of the combustion chamber wall to avoid buckling or distortion of combustor can 60.

Embodiments of the present invention comprise a programmable logic controller ("PLC") for controlling both indirect boiler 30 and superheater 50. Preferably, a single PLC controls both boiler 30 and superheater 50. A single water flow meter and a variable speed water pump 14 can provide for the desired total water flow. The PLC preferably controls fuel valve 32 for indirect boiler 30 so that the energy added indirectly will be according to specification. Variable speed blower 34 can provide for the proper amount of combustion air into the atmospheric pressure burner of boiler 30. Hence, steam quality exiting the indirect contact boiler 30 can be specified, and if flue gas injection is to be minimized, the quality of this steam is preferably high, up to 100%. This way, only about 0% to about 25% of total energy is added in superheater 50, with an attendant minimization of flue gases to be injected into the formation.

If a high volume of flue gases is desired, indirect boiler 30 can be completely shut down so that the water entering superheater 50 will be totally liquid and all of the supplied energy will come via superheater 50. This option is possible because most or all of the water borne solids can be removed in feedwater supply 12, for example by reverse osmosis or other demineralizing methods. Superheat can be achieved in superheater 50 by simply limiting the water supply, in comparison to the firing rate of combustor 60 in superheater 50. In this case, the PLC control point is preferably the temperature of the discharge from the direct contact steam generator 50. Thermal protection of the combustor 60 will be as with previous designs for a superheater 50. If injection of saturated water vapor has been chosen as the method for cooling combustor 60 within superheater 50, then that stream can pass through the superheater 50 without heat addition, i.e., no-fire in the direct contact section.

Embodiments of the present invention can operate without boiler 30. Preferably, superheater 50, in the absence of boiler 30, operates to produce a discharge stream comprising steam in either the saturated region, or the superheat region, with flue gases co-mingled. Such embodiments do not require any hardware equipment modification other than to provide a system to remove all solids in feedwater 12—optionally using reverse osmosis or similar water purification pretreatment and the addition of a PLC to control the firing rate.

Embodiments of superheater 50 of are preferably compact and can be easily configured for transport and relocation with a minimum of ancillary equipment with conventional legal-width trailers or skids. Preferably, the piping, metering, control valves, and controller of superheater 50 can be a unit that is of a size capable of transport in trailers or load bearing vehicles.

Embodiments of the present invention comprise methods and apparatuses for locating superheater 50 downhole within well 70. For deep oil formations, the high temperatures leaving a surface superheater 50 can be significant. Preferably, superheater 50 is located below a conventional thermal packer, or above an extreme temperature thermal packer, downhole within well 70, while the indirect contact boiler will remain on the surface and deliver saturated steam vapor to the wellhead and then be transported down injection tubing to superheater 50. Preferably this is accomplished by passing surface-generated saturated steam vapor 36 through a conduit into well 70 and passing through a superheater section. Other lines deliver the fuels, oxidizer, and instrumentations for superheater 50 through a tube in the thermal packer. If an ordinary thermal packer is used, these lines are preferably pass through the packer internally to the saturated steam conduit. If the superheater 50 is placed above an extreme temperature thermal packer, these lines are preferably connected directly to the superheater 50. Saturated steam is preferably accompanied by the conventional delivery methods for preserving energy in the bore of well 70 and allow use of a conventional thermal packer. Because superheating may occur below the thermal packer, the casing environment and packer environment will not experience the superheated condition. In this manner, thermal stress on the casing of well 70 is avoided, the heat losses are limited to those typical of steam injection practices, and a traditional thermal packer will not be exposed to extreme temperatures, provided that superheater 50 is located below the packer. Preferably, the fuel and oxidizer, along with a thermocouple to verify combustion, pass through a saturated steam conduit via tubing inside an external tube. High pressure oxidizer 54 for superheater 50 can optionally be compressed air, oxygen, and/or liquid oxidizers including but not limited to nitric acid, to provide advantages in such applications as downhole deployment of superheater 50. For ignition, a pyrophoric fluid such as tri-ethyl borane (TEB), is preferably injected in the fuel supply line. In order to inhibit the pyrophoric fluid from pre-ignition, a nitrogen blanket is preferably injected into the fuel line to purge any air before start up or re-start. Once the igniter fluid has been injected into the fuel supply tubing, it is preferably followed by the fuel, so that prompt ignition at the superheater flame holder will be experienced. Metering and control of fuel and oxidizer for the superheater will be performed on the surface. Downhole superheater 50 is not appropriate for all wells, so some embodiments of the present invention do not place superheater 50 downhole.

The separation of boiler 30 from superheater 50 permits superheater 50 to be installed downhole, and/or facilitates a field-wide development where boiler 30, which can be a large centralized conventional boiler, supplies saturated steam to multiple superheaters 50 which are located at/near the wellhead of well 70. In this manner, heat loss from the elevated temperature corresponding to superheater output is avoided. Typical conventional boilers for heavy oil thermal stimulation are rated at 50 million Btu/hr, and this is distributed simultaneously to multiple wells. Where conventional boilers have already been installed, it is anticipated that direct contact superheaters 50 can be located at each well 70, and will take the steam flow into superheat. The rating of the individual superheaters 50 are determined based on the degree of superheat desired and any governmental regulations, ranging usually from about 1 to about 15 million Btu/hr each. The individual superheaters 50 can all be controlled from a central control unit which can monitor wellhead pressure and flows of steam, fuel and oxidizer to each superheater 50, and control to desired superheat temperatures so that the output and pressure rating of central boiler 30 will not be exceeded.

Embodiments of the present invention are preferably adaptable to not only reservoir variables, but also time variables, in consideration of the sequence of stimulation fluids which can result in optimal recovery in a particular well/field. For example, early in the stimulation where free void fraction in a particular formation is low, either hot water, or two-phase steam in the saturated region can be the best choice. After one or more production cycles, the free void volume will increase because of oil extraction. Then, the amount of flue gas and superheat can subsequently be increased in stepwise fashion to expand the treated region surrounding each injection well to result in continued economic oil recovery.

In the preferred embodiment, and as readily understood by one of ordinary skill in the art, the apparatus according to the invention will include a general or specific purpose computer or distributed system programmed with computer software implementing the steps described above, which computer software may be in any appropriate computer language, including C++, FORTRAN, BASIC, Java, assembly language, microcode, distributed programming languages, etc. The apparatus may also include a plurality of such computers/distributed systems (e.g., connected over the Internet and/or one or more intranets) in a variety of hardware implementations. For example, data processing can be performed by an appropriately programmed microprocessor, computing cloud. Application Specific Integrated Circuit (ASIC), Field Programmable Gate Array (FPGA), Programmable Logic Controller (PLC), or the like, in conjunction with appropriate memory, network, and bus elements.

Note that in the specification and claims, "about" or "approximately" means within twenty percent (20%) of the numerical amount cited. All computer software disclosed herein may be embodied on any non-transitory computer-readable medium (including combinations of mediums), including without limitation CD-ROMs, DVD-ROMs, hard drives (local or network storage device), USB keys, other removable drives, ROM, and firmware.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. A system for generating superheated steam for injection into an oil well comprising:

a direct-contact superheater performing combustion and operating on feedwater in either a liquid state or a gas state or some combination of both states and generating a superheated steam having a specified ratio of non-condensable combustion gases to steam for injection into the oil well, the superheated steam causing pyrolysis of the oil;

a boiler heating the feedwater before the feedwater is passed to a separator;

said separator separating liquid from the feedwater before at least a fraction of vapor phase of the feedwater is passed to the direct-contact superheater; and returning the liquids separated by said separator to the boiler.

2. The system of claim 1 further comprising a water purifier for receiving the feedwater before the feedwater is operated on by said direct-contact superheater and purifying the feedwater such that the amount of solids within the feedwater does not exceed a predetermined amount for delivery to said direct-contact superheater.

3. The system of claim 1 wherein said direct-contact superheater operates using compressed air, gaseous oxygen, and/or liquid oxidizers.

4. The system of claim 1 wherein said direct-contact superheater comprises a combustion chamber lined with a refractory material.

5. The system of claim 1 wherein said direct-contact superheater comprises a combustion chamber fabricated of a metal alloy with a low coefficient of thermal expansion.

6. The system of claim 1 wherein said direct-contact superheater is located within the oil well and below a thermal packer.

7. The system of claim 1 wherein said boiler comprises an indirect-contact steam generator connected to said direct-contact superheater through said separator, said indirect-contact steam generator operating on the feedwater before the feedwater is operated on by said separator and said direct-contact superheater, said indirect-contact steam generator generating a specified quantity and/or quality of feedwater vapor for delivery to said direct-contact superheater through said separator.

8. The system of claim 7 further comprising a water purifier for receiving the feedwater before the feedwater is operated on by said indirect-contact steam generator and purifying the feedwater such that the amount of solids within the feedwater does not exceed a predetermined amount for delivery to said indirect-contact steam generator.

9. The system of claim 7 wherein said direct-contact steam generator comprises a combustion chamber comprising at least one fin on an external surface of said combustion chamber and a metal sleeve surrounding said at least one fin and said combustion chamber.

10. The system of claim 7 wherein said direct-contact superheater comprises a combustion chamber comprising openings to receive at least a fraction of feedwater vapor generated by said indirect-contact steam generator.

11. The system of claim 7 wherein, said direct-contact superheater receives the feedwater for cooling before the feedwater is operated on by said indirect-contact steam generator.

12. The system of claim 7 further comprising a programmable logic control system for directing the operation of said direct-contact superheater and said indirect-contact steam generator.

13. A method for generating superheated steam for injection into a well comprising:

receiving feedwater;

producing heated feedwater by heating the feedwater with a boiler, wherein the heated feedwater is either in a liquid state or a gas state or some combination of both states;

passing at least some of the heated feedwater to a separator that separates liquid-phase feedwater from vapor feedwater;

passing at least some of the vapor feedwater from the separator to a direct-contact superheater;

feeding the liquid-phase feedwater from the separator to the boiler;

generating superheated steam having a specified ratio of non-condensable combustion gases to steam using the direct-contact superheater to perform combustion and operate on the heated feedwater;

injecting the superheated steam into the well; and using gas created by pyrolysis of oil in the well as fuel for the boiler.

14. The method of claim 13 further comprising purifying the feedwater or the heated feedwater such that the amount of solids within the feedwater or the heated feedwater does not exceed a predetermined amount.

15. The method of claim 13 wherein producing heated feedwater by heating the feedwater with a boiler comprises generating feedwater vapor using an indirect-contact steam generator connected to the direct-contact superheater through the separator, wherein the indirect-contact steam generator operates on the received feedwater before at least some of the vapor from the heated feedwater is operated on by the direct-contact superheater, and wherein the indirect-contact steam generator generates a specified quantity and/or quality of feedwater vapor for delivery to the direct-contact superheater.

16. The method of claim 15 further comprising cooling the direct-contact superheater using at least a fraction of the feedwater vapor generated by the indirect-contact steam generator, wherein the direct-contact superheater comprises a combustion chamber comprising at least one fin on an external surface of the combustion chamber and a metal sleeve surrounding the at least one fin and the combustion chamber.

17. The method of claim 15 further comprising cooling the direct-contact superheater using at least a fraction of the feedwater vapor generated by the indirect-contact steam generator, wherein the direct-contact superheater comprises a combustion chamber comprising small openings to receive at least a fraction of the feedwater vapor generated by the indirect-contact steam generator.

18. The method of claim 15 further comprising cooling the direct-contact superheater using the feedwater before the feedwater is operated on by the indirect-contact steam generator.

19. A method for generating superheated steam for injection into an oil well comprising:

receiving feedwater;

generating feedwater vapor from the feedwater using an indirect-contact steam generator, wherein the indirect-contact steam generator comprises fuel and oxidizer inputs for combustion;

generating superheated steam using the feedwater vapor using a direct-contact superheater, wherein the direct-contact superheater comprises fuel and oxidizer inputs for combustion;

separating liquid feedwater from the feedwater vapor after the feedwater vapor is generated by the indirect contact steam generator and before passing at least some of the water vapor to the direct contact superheater;

controlling the fuel and oxidizer inputs on the indirect-contact steam generator and the direct-contact superheater to specify a ratio of non-condensable combustion gases to steam; and generating gas by pyrolysis of oil in the oil well with heat introduced by the superheated steam.

* * * * *